US009347728B1

(12) United States Patent
Richwald et al.

(10) Patent No.: US 9,347,728 B1
(45) Date of Patent: May 24, 2016

(54) SECURE DISRUPTER UNIT FOR EXPLOSIVE ORDNANCE DISPOSAL OPERATIONS

(71) Applicants: Alan Richwald, Newton, NJ (US); Brian Casteel, Stroudsburg, PA (US); Brent Donahue, Newton, NJ (US); Michael Freeman, Pompton Lakes, NJ (US); Nathan Leniz, Dover, NJ (US)

(72) Inventors: Alan Richwald, Newton, NJ (US); Brian Casteel, Stroudsburg, PA (US); Brent Donahue, Newton, NJ (US); Michael Freeman, Pompton Lakes, NJ (US); Nathan Leniz, Dover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 78 days.

(21) Appl. No.: 14/311,780

(22) Filed: Jun. 23, 2014

Related U.S. Application Data

(60) Provisional application No. 61/839,517, filed on Jun. 26, 2013.

(51) Int. Cl.
*F41A 25/00* (2006.01)
*F41A 23/02* (2006.01)

(52) U.S. Cl.
CPC ..... *F41A 23/02* (2013.01)

(58) Field of Classification Search
CPC ..... F42D 5/04
USPC ..... 86/50; 89/1.13; 102/402, 403
See application file for complete search history.

(56) References Cited

U.S. PATENT DOCUMENTS

| | | | | | |
|---|---|---|---|---|---|
| 4,169,403 | A * | 10/1979 | Hanson | F42B 33/062 | 102/293 |
| 6,439,127 | B1 * | 8/2002 | Cherry | F24B 12/36 | 102/402 |
| 7,299,735 | B2 * | 11/2007 | Alford | F42B 33/062 | 86/43 |
| 7,501,551 | B2 * | 3/2009 | Eidelman | C06B 21/0091 | 102/402 |
| 8,245,430 | B1 * | 8/2012 | Owenby | F41A 19/69 | 42/84 |
| 2006/0011056 | A1 * | 1/2006 | Edwards | F41A 25/02 | 89/14.3 |

* cited by examiner

*Primary Examiner* — Samir Abdosh
(74) *Attorney, Agent, or Firm* — Michael C. Sachs

(57) ABSTRACT

A disrupter unit is used for explosive ordnance disposal by firing a slug into the ordnance to be destroyed. A method is shown to secure the disrupter unit to a sand bag or other stationary location during such firing of the disrupter unit. The present invention may also adapt the disrupter unit to shear wire, such as barbed wire, by attaching a wire cutter element to the disrupter unit through a robust cable during firing. Likewise, the disrupter unit may be used as a remote pull device or further to unearth a buried item via mechanical advantage, wherein a military shovel or another long rod is attached by a robust cable to the disrupter unit.

4 Claims, 5 Drawing Sheets

SECURE DISRUPTER UNIT FOR EXPLOSIVE ORDNANCE DISPOSAL OPERATIONS

CROSS REFERENCE TO RELATED APPLICATION

This application claims benefit under 35 USC §119 (e) from Provisional Patent Application No. 61/839,517 filed Jun. 26, 2013 the entire file wrapper contents of which application are hereby incorporated as though fully set forth.

U.S. GOVERNMENT INTEREST

The inventions described herein may be made, used, or licensed by or for the U.S. Government for U.S. Government purposes.

BACKGROUND OF INVENTION

Current disrupters used in Explosive Ordnance Disposal (EOD) operations are remotely-fired, single-shot, smooth-bored gun tubes which propel simple slugs via specialized blank cartridges. In general, these devices (such as the 0.50 cal MK2 De-Armer) do not weigh much more than the slugs they propel, and the recoil force on the disrupter is tremendous. There is currently and historically a problem with locating the disrupter after an initiation. If not properly secured, a disrupter can be thrown a tremendous distance. According to one aspect of this invention, by providing means for attaching a high-tensile strength rope or cable to the disrupter, the system can be much more easily attached to a sandbag or other weight which will prevent such recoil from propelling the disrupter rearward, or in other unwanted directions.

In another aspect of the invention, an operator may attach the cable to a wirecutter, e.g., as well as to the sandbag (or other weight), and the disrupter can also or simultaneously be used as a remote wire-cutting tool. In this mode, the force of the recoiling disrupter and its attached wire-cutter will shear through whatever wire it had been pre-positioned to cut.

In yet another aspect of the invention, the cable maybe attached to a military shovel, e.g., or another long rod, which can use the recoiling force of the disrupter to unearth a buried item via mechanical advantage. In this way, the disrupter can also or simultaneously be used as a remote pull tool.

BRIEF SUMMARY OF INVENTION

The disrupter is fashioned with metal wings or ears cast into the disrupter's housing or onto the disrupter's screw in parts such as a breech plug. The ears are provided with holes that can serve as tie down points for a cable or the like. The cable can then be attached to a sandbag or like grounded position. Therefore, the disrupter can not fly off during a detonation operation which would have made it difficult or impossible to later locate it for reuse.

OBJECTS OF THE INVENTION

Accordingly, it is an object of the present invention to provide means to secure a disrupter unit to a sand bag or other stationary heavy means, prior to firing the disrupter unit.

Another object of the present invention is to use the disrupter unit to shear wire, such as barbed wire, by attaching a wire cutter element to the disrupter unit through a robust cable.

A still further object of the present invention is to use the disrupter unit as a remote pull device, or further to unearth a buried item via mechanical advantage, wherein a military shovel, or another long rod, is attached by a robust cable to the disrupter unit.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
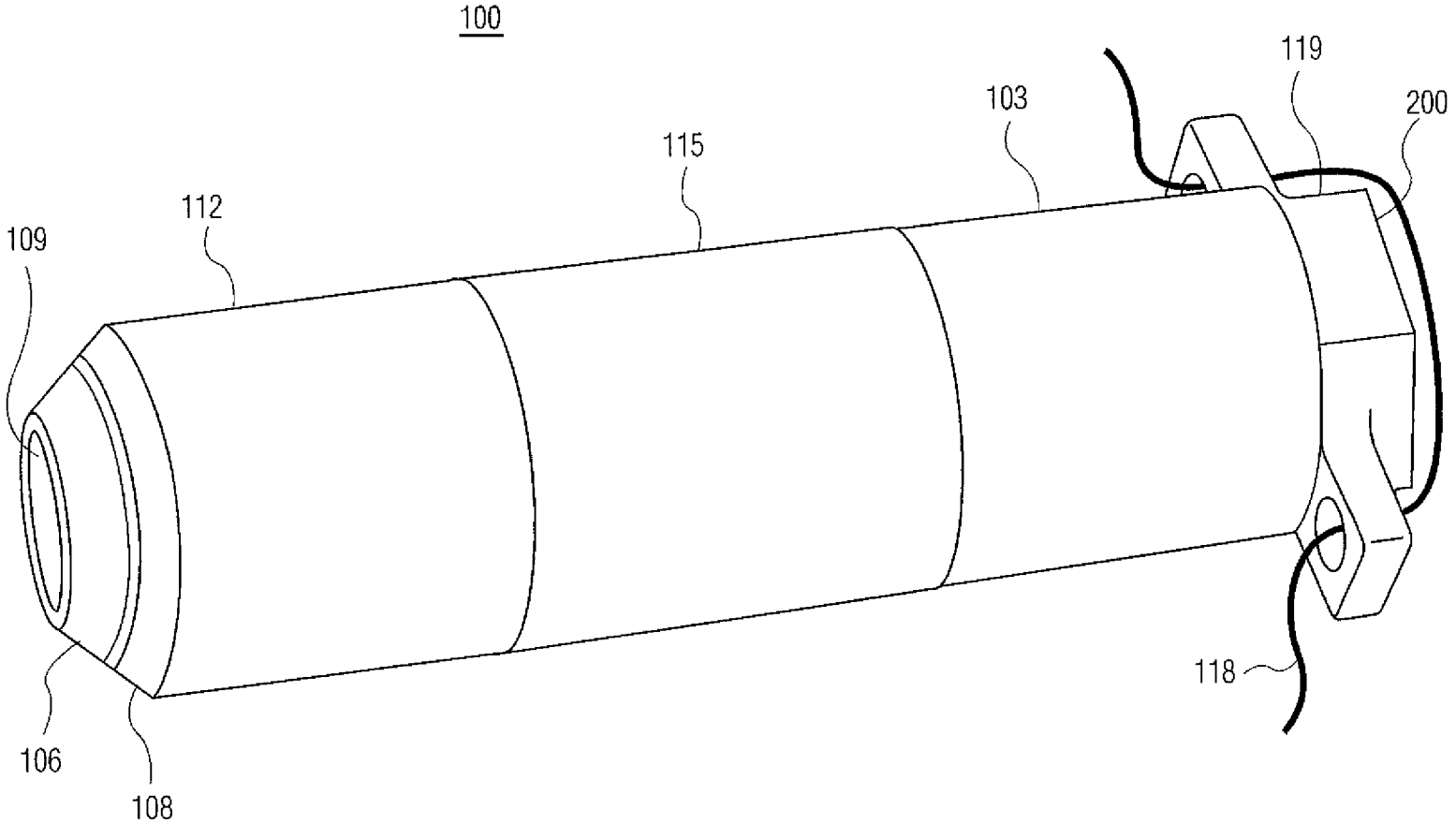
FIG. 1 shows the secure disrupter unit assembly according to this invention.
Figure 2:
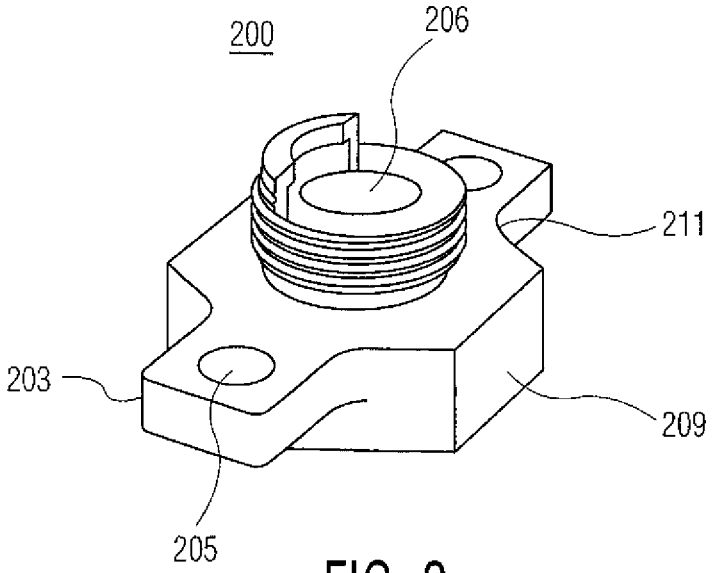
FIG. 2 shows an isometric view of a winged breech plug used with the secure disrupter unit according to this invention.
Figure 3:
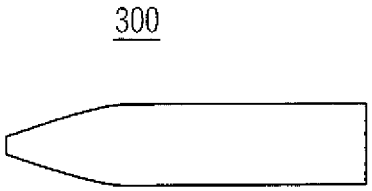
FIG. 3 shows a cross section view of a slug used with the secure disrupter unit according to this invention.

FIG. 1 shows a disrupter unit 100 in accordance with this invention. As mentioned, it is used to destroy an unwanted munition in explosive ordnance disposal operations. The disrupter is a remotely-fired, single-shot, smooth-bored gun tube which propels simple slugs via specialized blank cartridges. A slug, such as shown in FIG. 3 may be fired from channel 109 out of nose end 106 of gun unit 100 of FIG. 1 (the "disrupter"). The disrupter body 103 shown has a beveled front area 108, honed areas 112, and a knurled area 115. The slug is loaded into the aft end 119 of the disrupter, together with its firing charge (not completely shown). In practice, a firing line (not completely shown) is threaded from such firing charge, and continues through the center hole 206 (FIG. 2) of a breech plug 200. The aft end 119 of disrupter 100 is then closed off by screwing in the breech plug which has threads 211, such as by using a wrench, clenching on its hex shaped surfaces 209, and there are mating internal threads (not completely shown) inside the disrupter aft end. To use, the firing line would then be ignited (as one takes cover). The disrupter discharges with great force (and accompanying sound) and fires the slug 300 into the suspected munition to be destroyed. The disrupter may be reused repeatedly as desired, though it may be difficult to locate it physically after a firing.

Figure 4:
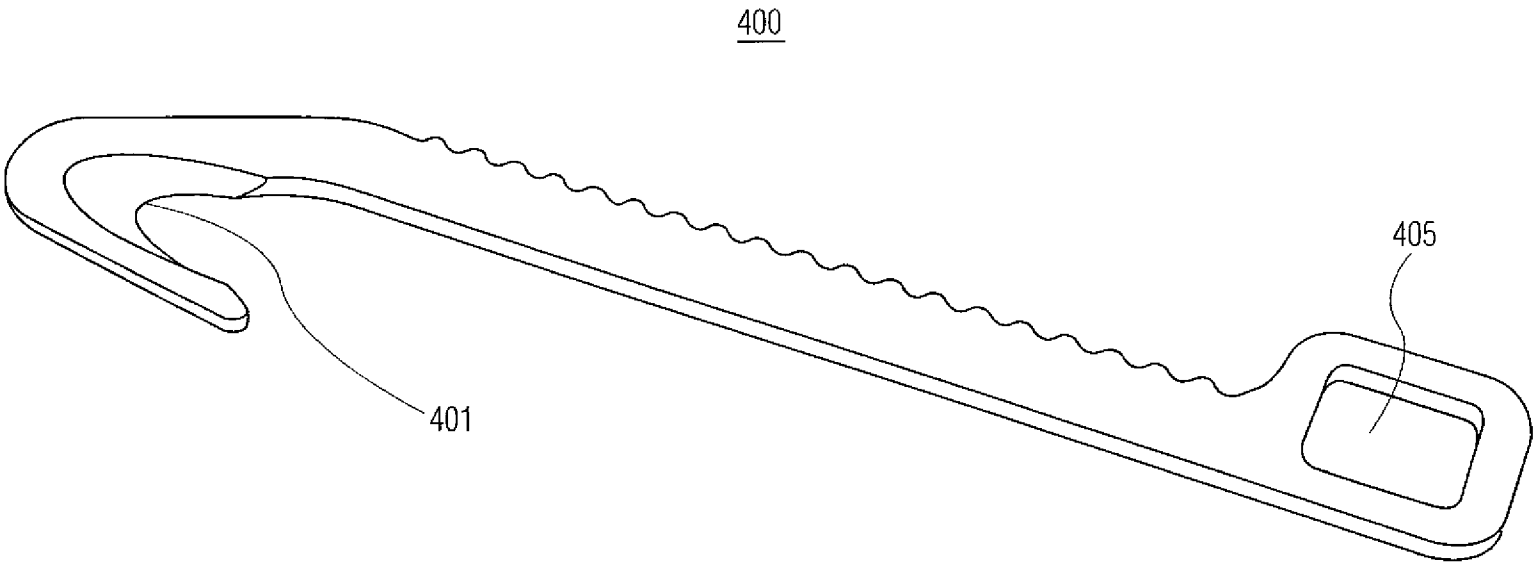
FIG. 4 shows a wire cutter element which could be used with the secure disrupter unit according to this invention.
Figure 5:
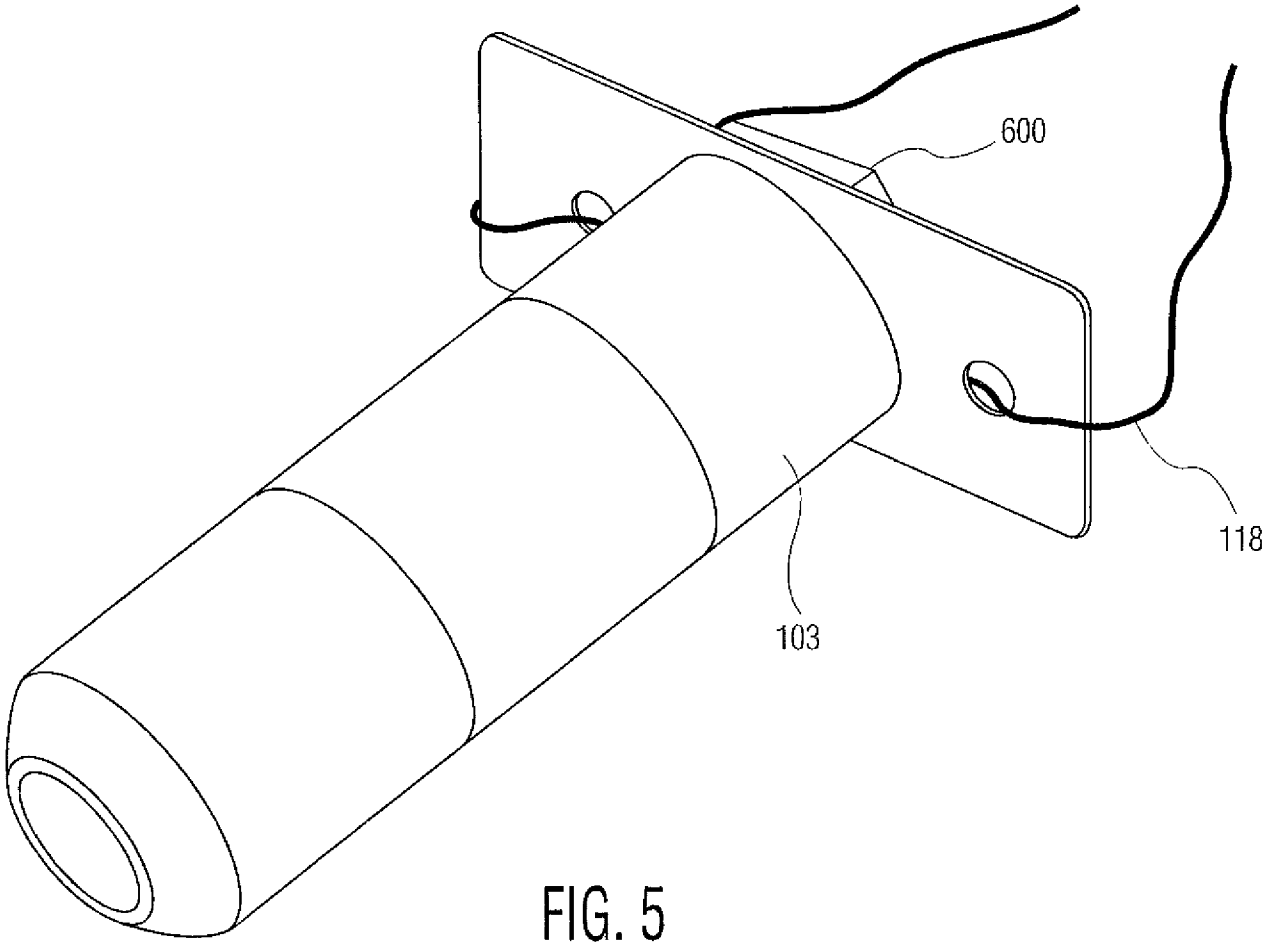
FIG. 5 shows a method to modify a conventional disrupter unit by adding a flange piece having tie down holes and a robust cable attached, according to this invention.
Figure 6:
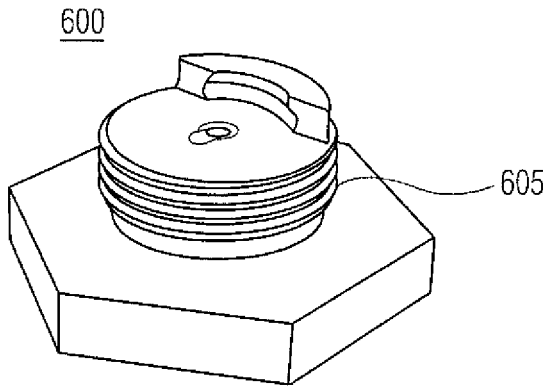
FIG. 6 shows an isometric view of a conventional breech plug used with a conventional disrupter unit.
Figure 7:
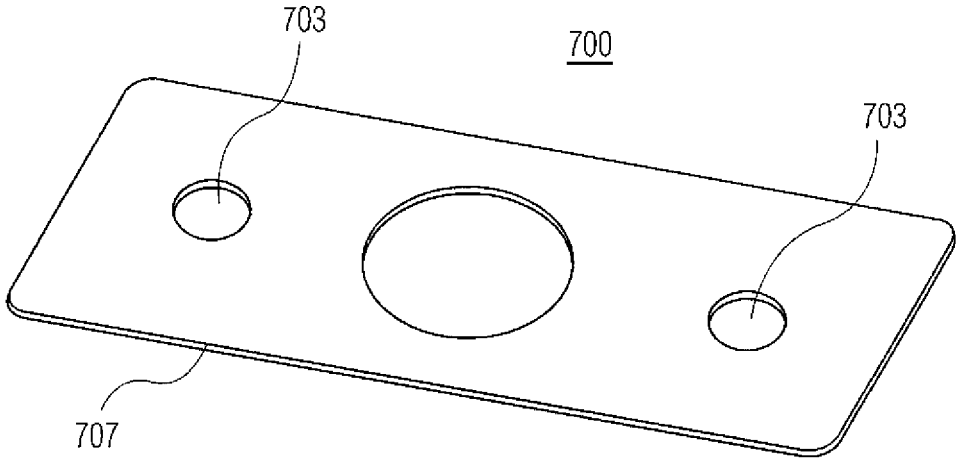
FIG. 7 shows a flange piece having tie down holes used to adapt a conventional disrupter unit according to this invention.

Breech plug 200 therefore has a chord 118 wound through pre-provided tie down point holes 205 in wings ("ears") 203 of the breech plug. This single-piece breech plug may be produced in traditional steel as well as titanium, and both have been found to work reliably. The chord can also be manufactured to come with the breech plug 200. The chord may be military 550 chord or else a high-tensile strength rope or cable, or other similar means. As mentioned, chord 118 is meant to tie down the disrupter in place before firing, so the disrupter unit can be readily located after being discharged, and for preventing excessive rearward movement of the device during firing. Chord 118 could also be manufactured together with, and ready as a part of, breech plug 200. As an aside, since the disrupter pulls on chord 118 with enormous force during firing, chord 118 might also be used to do concurrent, other work, at the same time as (or in lieu of), destroying a munition. For example, it could be used to cut barbed wire (not shown), such as by using chord 118 for pulling hole 405 of wire cutter 400 in FIG. 4, to snap barbed wire which could be put in cutting oval 401. Chord 118 might also be attached to a shovel, or to a jack hammer cutter, as other examples. Testing has also been conducted with attaching such cable to a military shovel or other long rod which can use the recoiling force of the disrupter to unearth a buried item via mechanical advantage. Thus, the disrupter can also be used as a remote pull tool. FIG. 5 shows a way to jerry rig an existing disrupter in the field. One could use a retaining plate 700 (FIG. 7) with only a conventional breech plug 600 (FIG. 6). Shaft 605 on plug 600 could fit through hole 707, whereas chord 118 could be wound through holes 703. The actual EOD Disrupter Retaining Plate is a very simple metal stamping, made from thin sheet steel. It has a large center hole, smaller than the outer diameter of the disrupter it is mated to, but larger than the threading on the accompanying breech plug. As such, it can be wedged in between the barrel/disrupter body and the threaded breech. In addition to this center hole, the Retaining Plate contains two other, smaller holes, used as tie-down points for military 550 chord or any other rope or cabling. Of course, it is preferred to have the breech plug of FIG. 2 with tie down points for chord 118 pre-manufactured therewith.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A stabilized disrupter unit, comprising means to tie down said disrupter to a stationary object prior to firing said disrupter unit, said means comprising tie down holes included in said disrupter unit, and a heavy duty chord attached through said holes to both the disrupter unit and to said stationary object and wherein said tie down holes are included on a breech plug, and said breech plug is screwed in to an aft end of said disrupter unit so that the breech plug is firmly attached to said disrupter unit and wherein said chord is military 550 chord.

2. A stabilized disrupter unit, comprising means to tie down said disrupter to a stationary object prior to firing said disrupter unit, said means comprising tie down holes included in said disrupter unit, and a heavy duty chord attached through said holes to both the disrupter unit and to said stationary object and wherein said tie down holes are included on a breech plug, and said breech plug is screwed in to an aft end of said disrupter unit so that the breech plug is firmly attached to said disrupter unit and wherein said chord is a high-tensile strength rope.

3. A stabilized disrupter unit, comprising means to tie down said disrupter to a stationary object prior to firing said disrupter unit, said means comprising tie down holes included in said disrupter unit, and a heavy duty chord attached through said holes to both the disrupter unit and to said stationary object and wherein said tie down holes are included on a breech plug, and said breech plug is screwed in to an aft end of said disrupter unit so that the breech plug is firmly attached to said disrupter unit and wherein said chord is high-tensile strength cable.

4. A stabilized disrupter unit, comprising means to tie down said disrupter to a stationary object prior to firing said disrupter unit, said means comprising tie down holes included in said disrupter unit, and a heavy duty chord attached through said holes to both the disrupter unit and to said stationary object and wherein said tie down holes are included on an adapter plate, said adapter plate having a further hole in its central area sized to fit through a shaft part of a breech plug, and wherein said breech plug is screwed in to an aft end of said disrupter unit so that the breech plug firmly attaches said adapter plate plus breech plug to said disrupter unit.

* * * * *